US008621998B2

(12) United States Patent
Ballantine et al.

(10) Patent No.: US 8,621,998 B2
(45) Date of Patent: Jan. 7, 2014

(54) REMOTE INITIATOR BREACHING SYSTEM

(75) Inventors: Roger Neil Ballantine, Wellington (NZ); Tony Humphries, Wellington (NZ); Deon Grobler, Wellington (NZ); Drago Lavrencic, Ryde (AU); David Hamilton, Upper Hutt (NZ)

(73) Assignee: Mas Zengrange (NZ) Limited (NZ)

( * ) Notice: Subject to any disclaimer, the term of this patent is extended or adjusted under 35 U.S.C. 154(b) by 0 days.

(21) Appl. No.: 13/496,420

(22) PCT Filed: Dec. 2, 2009

(86) PCT No.: PCT/NZ2009/000276

§ 371 (c)(1),
(2), (4) Date: Apr. 6, 2012

(87) PCT Pub. No.: WO2011/034442

PCT Pub. Date: Mar. 24, 2011

(65) Prior Publication Data

US 2012/0192744 A1 Aug. 2, 2012

(30) Foreign Application Priority Data

Sep. 16, 2009 (NZ) ..... 579690

(51) Int. Cl.
*F42D 1/05* (2006.01)
*F42D 1/055* (2006.01)
*F42B 3/14* (2006.01)

(52) U.S. Cl.
USPC ..... 102/206; 102/200; 102/202.8; 102/301; 102/322; 102/275.6; 361/248

(58) Field of Classification Search
USPC ..... 102/301, 320, 322, 332, 200, 206, 102/202.8, 202.9, 202.12, 202.14, 275.5, 102/275.6, 275.11; 361/248, 249
See application file for complete search history.

(56) References Cited

U.S. PATENT DOCUMENTS

| | | | | |
|---|---|---|---|---|
| 3,780,654 | A * | 12/1973 | Shimizu et al. | 102/312 |
| 4,576,093 | A * | 3/1986 | Snyder | 102/200 |
| 4,884,506 | A * | 12/1989 | Guerreri | 102/200 |
| 6,260,483 | B1 * | 7/2001 | Snyder | 102/218 |
| 6,546,873 | B1 * | 4/2003 | Andrejkovics et al. | 102/200 |

(Continued)

FOREIGN PATENT DOCUMENTS

| | | |
|---|---|---|
| WO | 0020821 | 4/2000 |
| WO | 2008035987 | 3/2008 |

OTHER PUBLICATIONS

International Search Report for PCT/NZ2009/000276, Completed by the Australian Patent Office on Jun. 4, 2010, 3 Pages.

*Primary Examiner* — James Bergin
(74) *Attorney, Agent, or Firm* — Brooks Kushman P.C.

(57) ABSTRACT

A remote initiator breaching system for initiating breaching charges over a short range requiring no physical link between the breacher and the demolition charge. The remote initiator breaching system has at least one transmitter, at least one receiver, at least one shock tube connectable to a breaching charge and a power source for each of the transmitter and receiver. The transmitter is able to generate and transmit a coded signal. The transmitter has an input for inputting operational commands into the transmitter for generating the coded signal, The transmitter has a plurality of channels representing different frequency bands, and multiple addresses for each channel such that transmission of the coded signal from the transmitter to the receiver is possible per individual addresses or all addresses simultaneously.

27 Claims, 7 Drawing Sheets

(56) References Cited

U.S. PATENT DOCUMENTS

| | | | | |
|---|---|---|---|---|
| 6,581,519 | B1 | 6/2003 | Adams | |
| 7,327,550 | B2 | 2/2008 | Meyer et al. | |
| 7,451,700 | B1 * | 11/2008 | Land | 102/218 |
| 7,665,401 | B2 * | 2/2010 | Ballantine et al. | 102/275.11 |
| 7,814,833 | B1 * | 10/2010 | Land | 102/275.6 |
| 8,134,822 | B2 * | 3/2012 | Ballantine et al. | 361/248 |
| 8,474,379 | B2 * | 7/2013 | Jacobson et al. | 102/215 |
| 2006/0011082 | A1 | 1/2006 | Jacobson et al. | |
| 2008/0276818 | A1 | 11/2008 | Ballantine et al. | |

* cited by examiner

REMOTE INITIATOR BREACHING SYSTEM

CROSS-REFERENCE TO RELATED APPLICATION

This application is the U.S. national phase of PCT Appln. No. PCT/NZ2009/000276 filed Dec. 2, 2009, which claims priority to New Zealand application 579690(NZ) filed on Sep. 16, 2009 the disclosures of which are incorporated in their entirety by reference herein.

The invention relates to a remote initiator breaching system, typically a remote initiator breaching system for initiating breaching charges over a short range requiring ho physical link between the breacher and the demolition charge.

BACKGROUND OF INVENTION

The safety aspect and reliability of detonating of explosives is paramount as the consequences associated unsafe and unreliable detonation can be castrophic. As such there are requirements for the military, other related defence agencies and other users of explosives to safely detonate explosives. Safely in this context means: safely separated in distance; safely separated in time and security of initiation. Explosives can be initiated by electrical circuit cable or other non-electrical 'cable', however in cases of electrical initiation, long cable lengths allow greater susceptibly to initiation of the charge via electro-magnetic induction onto the cable (radio signals or lightning strikes).

Security of initiation requires that the explosive must not be initiated falsely, either because of erroneously decoded signals or deliberately spoofed signals. Also to ensure the extremely high level security required, the equipment must be protected against the possibility of the failure of microprocessors and the program code. The firing circuits must also be designed and analysed to a very high standard to ensure that component failure will not result in the firing voltage being incorrectly applied to the explosive circuit.

The remote initiation equipment needs to be as small in volume and as light weight as possible. The radio transmission system needs to operate over a good distance. The equipment needs to be very robust, being carried in an environment that includes; temperatures from −4° C. to +60° C., water depths of 20 metres and in aircraft flying to 30,000 ft.

Current remote initiator (RI) equipment are generally bulky and heavy with weights around 1.5 kg and volumes around 1500 cubic cm. This weight and volume is driven by the need to increase power endurance which leads to existing cumbersome battery solutions. Further the frequency bands may not be well chosen to achieve the required distances. This can also lead to increased power demand through the selected transmitter power level.

RI's having a single microprocessor can be suspect, as either a simple failure of the electronic machine or an untested software path could result in the triggering of the firing circuit. The safest assumption to make about a microprocessor and its program is that it could arbitrarily decide to initiate a firing event. To guard against such an event, a secondary processor with its own independent control of the firing circuit can be incorporated.

None of the existing remote initiators provide simplicity of use. A considerable amount of training and experience is required in any but the most simple of deployments. Also none of the existing RI's would appear to be applicable or designed for explosive method of entry and/or for initiating breaching charges over a short range requiring no physical link between the breacher and the demolition charge.

OBJECT OF THE INVENTION

It is an object of the invention to provide a remote initiator breaching system, typically a remote initiator breaching system for initiating breaching charges over a short range requiring no physical link between the breacher and the demolition charge, that ameliorates some of the disadvantages and limitations of the known art or at least provide the public with a useful choice.

SUMMARY OF INVENTION

In a first aspect the invention resides remote initiator breaching system, typically a remote initiator breaching system for initiating breaching charges over a short range requiring no physical link between the breacher and the demolition charge, the remote initiator breaching system includes at least one transmitter, at least one receiver, at least one shock tube connectable to a breaching charge and a power source for each of the transmitter and receiver, wherein the transmitter includes (i) means for generating and transmitting a coded signal and input means for inputting operational commands into the transmitter for generating the coded signal, (ii) sixteen channels representing different frequency bands, and (iii) ten addresses for each channel such that transmission of coded signal from the transmitter to the receiver is possible per individual addresses or all addresses simultaneously, and wherein the receiver includes (i) a shock tube interface adapted to interface directly with the shock tube connected to a breaching charge, (ii) a spark-initiator for initiating a spark at the shock tube interface in order to initiate the shock tube, and (iii) the receiver having means for receiving me coded signal from the transmitter and input means for inputting operational commands into the receiver for generating an output signal for the initiation of the shock tube upon receipt of a valid transmitted coded signal.

Preferably, the remote initiator breaching system has two transmitters, the first being a primary transmitter and the second a back up transmitter, wherein the back up transmitter is configured and coded the same as the primary transmitter.

Preferably, the remote initiator breaching system consists of a primary transmitter, a backup transmitter and up to ten receivers, wherein the receivers are bonded to the primary transmitter and adapted to be initiated individually or all at the same time Preferably the remote initiator breaching system has a bonding/mounting interface on both the transmitter and receiver, the bonding/mounting interface is adapted to allow for electrical contact between transmitter and receiver to transfer configuration data from the transmitter to the receiver and to allow positive location of the receiver on the transmitter during bonding.

Preferably, the transmitters and receivers have internal antennae.

Preferably, the transmitter and receiver each have dual processing means that are independent of each other to provide independent control of a firing circuit and adapted to synchronise with each processing means before initiation can occur so as to enhance safety and reliability of the transmitter and receiver and the initiation of the remote initiator breaching system Preferably, the remote initiator breaching system is able to operate within iron vessels such as ships and sea platforms.

Preferably, the receiver is adapted to dock via the bonding/mounting interface with the transmitter in high-electro-magnetic environments in order to allow for manual firing of a single circuit wherein the transmitter does not transmitter RF to the receiver in this situation.

Preferably, the receiver has 180° viewable indicators so that the operator can carry-out communications check from a distance, for example 35-80 metres from the receiver.

Preferably, the remote initiator breaching system operates over short ranges, for example less than 100 m, in constrained urban environment and in iron vessels.

Preferably, the receiver is disposable and useable once.

Preferably, the remote initiator breaching system is very light weight.

Preferably, the transmitter is adapted to worn the wrist of a user.

Preferably, the remote initiator breaching system is adapted and designed for explosive method of entry into a structure or vessel.

Preferably, the remote initiator breaching system includes both shock-tube and electrical receiver initiators.

Preferably, the remote initiator breaching system includes the capability to select any of 16 operating frequency channels, where each channel is associated with a particular frequency band.

Preferably, the delay from the initiation of a firing command from the transmitter to appearance of a firing spark on the receiver shock tube interface is not more than 0.5 sec.

Preferably, the remote initiator breaching system is capable of firing ten addresses consecutively with a maximum interval period of <4 seconds between each firing command.

Preferably, the remote initiator breaching system operates in the frequency range 868.7-869.2 MHz and has a channel spacing of 12.5 kHz.

Preferably, the transmitter is capable of transmitting a firing code at a selected frequency/channel.

Preferably, the initiation of a firing code transmission require the operation of two keys on the transmitter.

Preferably, the receiver has a mechanical interface for clipping onto a shock tube.

Preferably, the shock tube interface accommodates for two diameters of shock tube.

Preferably the receiver includes dual safety timers with independent timing sources such that the dual safety timers are adapted to prevent arming of the receiver until a fixed time has elapsed from the initiation of arming so that if the two safety timers do not time out within a specified time of each other the receiver indicates an error and does not proceed to its armed state.

Preferably the transmitter includes built-in test circuits to confirm safety, reliability, and shut down in safe state if fault detected.

Preferably, the transmitter requires simultaneous two button operation required for firing.

Preferably, the receiver includes built-in test circuits to confirm safety, reliability, and shut down in safe state if fault detected.

In a second aspect the invention resides a method of operating the remote initiator breaching system, the method includes (i) bonding of a receiver or receivers to transmitter (ii) deployment of the bonded receiver or receivers (iii) undertaking a communications check on the receiver or receivers and (iv) firing the remote initiator breaching system remotely or manually.

Preferably, the firing is done remotely where the firing signal is relayed from the transmitter to the receiver by radio frequency.

In other aspects herein described

BRIEF DESCRIPTION

The invention will now be described, by way of example only, by reference to the accompanying drawings:

FIG. 1 is a concept layout of the remote initiator breaching system in accordance with a first preferred embodiment of the invention.

FIG. 2 is a system block diagram for the remote initiator breaching system in accordance with a first preferred embodiment of the invention.

FIG. 3 is a perspective view of a transmitter in accordance with a first preferred embodiment of the invention.

FIG. 4 is a perspective view of a transmitter with a wrist strap in accordance with a first preferred embodiment of the invention.

FIG. 5 is a perspective top view of a receiver in accordance with a first preferred embodiment of the invention.

FIG. 6 is a perspective bottom view of a receiver in accordance with a first preferred embodiment of the invention.

FIG. 7 is a perspective a receiver docked to a transmitter in accordance with a first preferred embodiment of the invention.

FIG. 8 is a flowchart describing the bonding of a receiver to a transmitter in accordance with a first preferred embodiment of the invention.

FIG. 9 is a flowchart describing the deployment of a receiver in accordance with a first preferred embodiment of the invention.

FIG. 10 is a flowchart describing the communications check on a receiver in accordance with a first preferred embodiment of the invention.

FIG. 11 is a flowchart describing the remote initiation firing in accordance with a first preferred embodiment of the invention.

FIG. 12 is a flowchart describing the manual firing initiation in accordance with a first preferred embodiment of the invention.

DESCRIPTION OF DRAWINGS

The following description will describe the invention in relation to preferred embodiments of the invention, namely a remote initiator breaching system, typically a remote initiator breaching system for initiating breaching charges over a short range requiring no physical link between the breacher and the demolition charge. The invention is in no way limited to these preferred embodiments as they are purely to exemplify the invention only and that possible variations and modifications would be readily apparent without departing from the scope of the invention.

Figure 1:
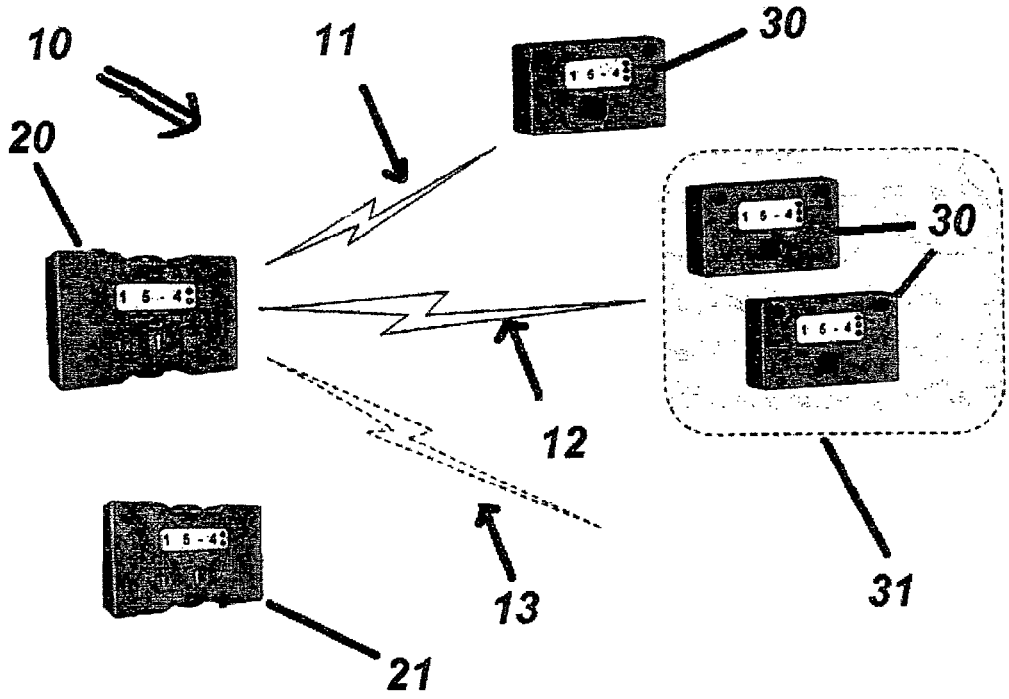
FIGS. 1 & 2 show the remote initiator breaching system 10 of the invention consists of a primary transmitter 20 and up to ten receivers 30, both of small size and weight. The remote initiator breaching system 10 can and preferably includes a standby transmitter 21, capable of replacing the primary transmitter 20 in case of loss or failure. Transmitter 21 acts as a reserve to maintain functional reliability in case of loss or damage to the primary a transmitter 20. In operation the transmitter 20 can be attached to the wrist of the breacher, while the receiver 30 can be installed in close proximity to the demolition charge and connected to the charge by a shock tube. The receiver 30 will initiate the shock tube on receiving a radio frequency (RF) 11, 12, 13 command from the transmitter 20. A multiple of up to ten receivers can be bonded to the same transmitter 20 and initiated individually or all at the same time (31). Different system configurations may be assembled according to operational need with the receivers 30 being associated (bonded) with a particular transmitter 20 by means of both frequency and group code. Unbonded receivers 30 maybe purchased or warehoused for replacement of consumed receivers within a set. Bonded receivers may also be unbonded and returned to the warehouse facility.
Figure 2:
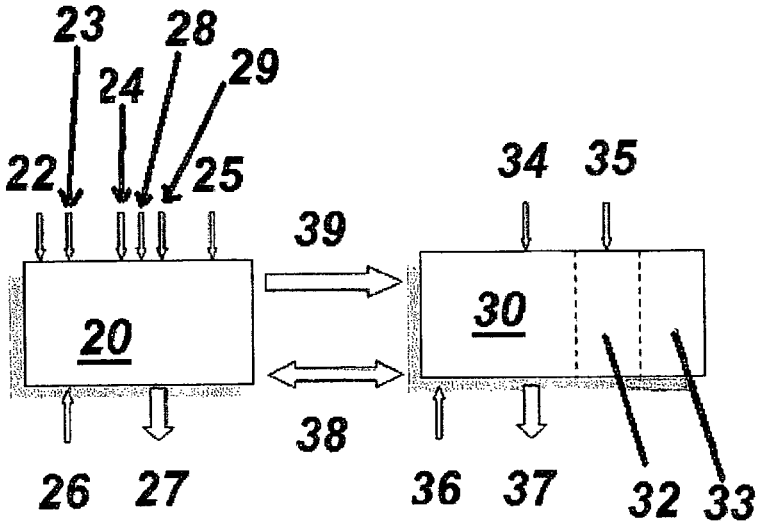
Figure 3:
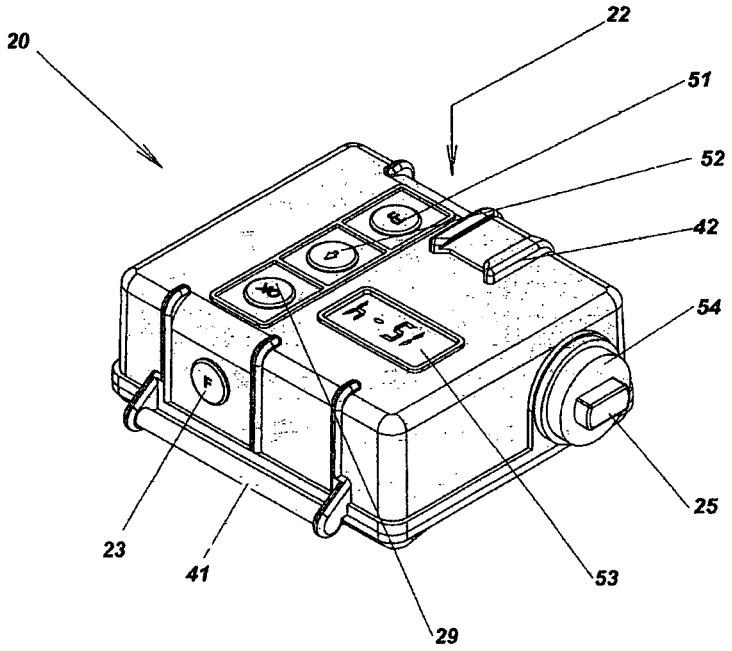
Figure 4:
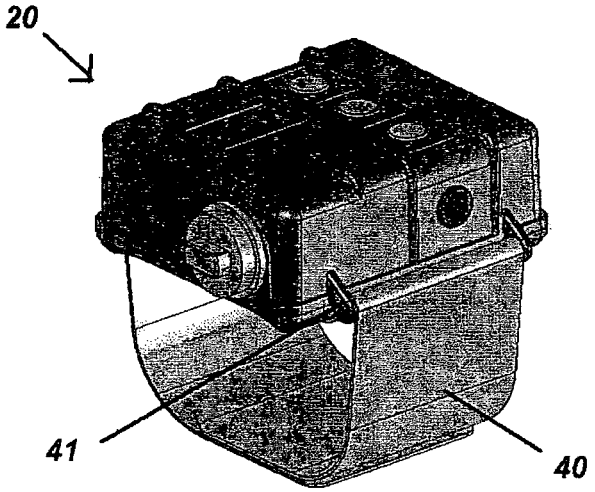
Figure 5:
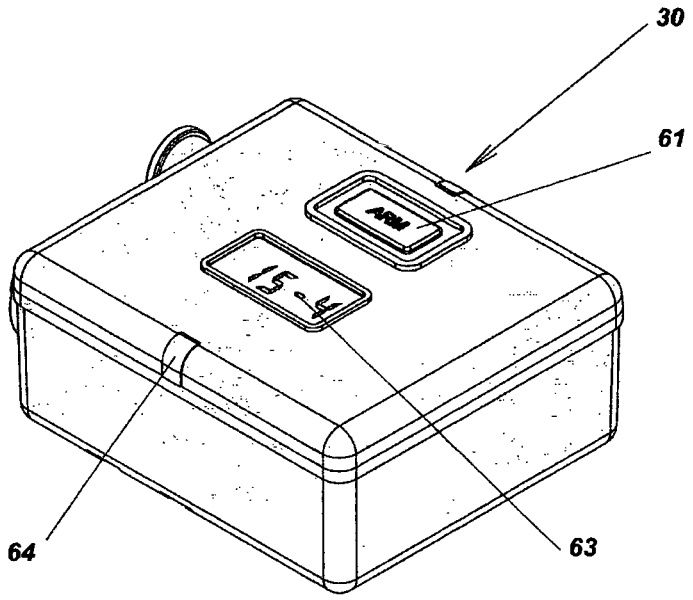
Figure 6:
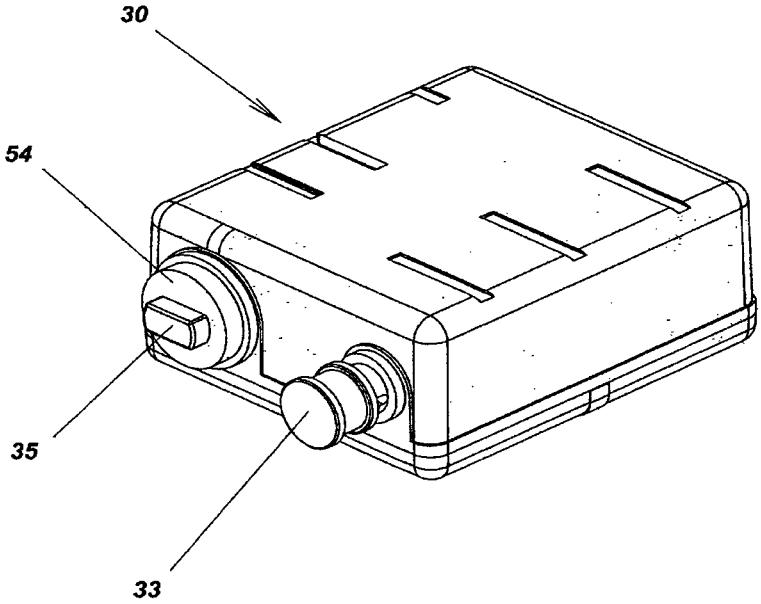

The receiver 30 has a spark-initiator 32 (FIG. 2) for shock-lube detonators. The receiver shock tube interface 33 (FIG. 2) is designed to handle a wide range of environmental conditions. The receiver 30 is designed as a disposable unit and is intended to be used operationally only once. To maintain safety the receiver records internally a count of the firing commands received. This count can be inspected pre-deployment, to ensure that a potentially damaged receiver is not carried on deployment. Recovered receiver parts can be forensically examined for evidence of multiple use. In a training situation users may wish to use receivers on multiple occasions.

Figure 7:
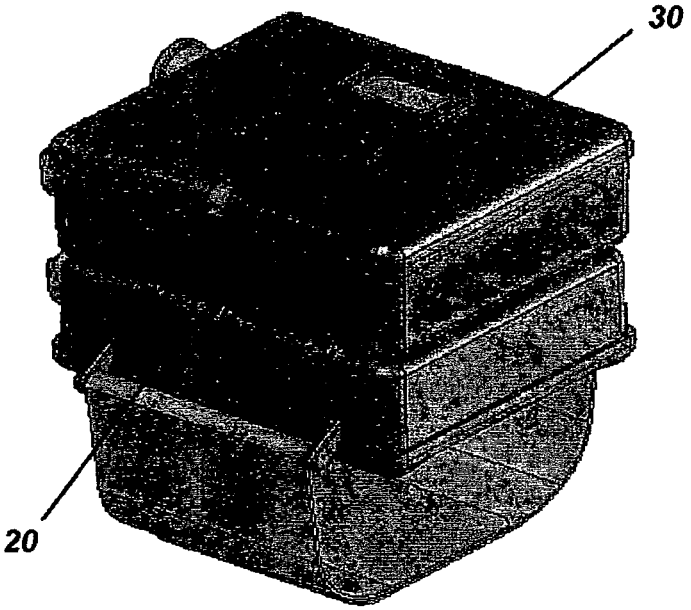

The remote initiator breaching system 10 can also be used to initiate shock-tube manually by clipping the receiver 30 on the top of its group transmitter 20 (FIG. 7). When used in this way there is no RF transmission, the command is issued directly from the transmitter 20 through contacts to the single attached receiver 30.

The remote initiator breaching system 10 is designed with safety engineering factors incorporated from its conception. The transmitter 20 and receiver 30 both include dual separate processors each, that must concur over the whole initiation process before initiation of the detonator can occur.

Turning to FIG. 3 to 7 the controls and indicators will now be described. The transmitter 30 (FIG. 3) has a power ON/OFF Switch 25 mounted on the top the transmitter battery tube 54. To switch the transmitter ON the switch 25 is rotated clockwise. When switch is in the ON position firing is possible, when switch is located in the OFF position (counterclockwise) firing is not possible. The fire button 23 is mounted on the top face of the transmitter 30 orthogonal to the keypad. It is used in conjunction with the Enable button 22 to send a fire command. Orientation is given with the display and three button keypad held vertically in front of the face and with the battery tube ON/OFF Switch to the left. The Enable button 23 is mounted on the bottom of the transmitter orthogonal to the keypad. Mounted on the front face of the transmitter is a 3 key tactile keypad. The functions are as follows:

OK (29) This key accepts a selected numeral or function. This key increments a numeral, or activates a function in conjunction with Function key.

Fn (51) Used in conjunction with other keys to activate functions: e.g. Communications Check Incremental Button (52)

The Transmitter LCD Display 53 is a back-light LCD display and is used to display: the channel number, select the receiver unit (including ALL), and error conditions. The transmitter also includes a docking part 52 to allow the receiver to be docked and held during manual firing (see FIG. 7). Also the transmitter 20 has two strap holders 41 to allow a wrist band 40 (FIG. 4) to be attached, preferably by clip-on action, to allow the transmitter 30 to be worn on the wrist of a user. Also the transmitter is adapted to be attached to the clothing of user using the same clip-on action for the wrist band.

The receiver 30 has a Power ON/OFF Switch 35 mounted on the top the receiver battery tube 54. To switch the receiver ON, the switch 25 is rotated clockwise. A receiver LCD Display 63 is situated on an upper face of the receiver. When the receiver is switched ON, the LED Display 63 carries out its build-in-tests, displays unit number, health, and channel number. Once the built-in-tests are complete, the receiver 30 can be ARMED with a 'double tap' of the ARM button 61. On entry into ARMED state the LED indicator will flash 3 times then display for continuously for 15 seconds before extinguishing. The receiver 30 has internal LEDs 64 with 180° field of view to indicate status. The LED is able do display Green & Red states. The Green state is used to indicate a healthy state: e.g. communication status after a Communications Check command from the transmitter. The Red state indicates various fault conditions: e.g. battery low. Protruding from the receiver is a shock tube interface 33 for interfacing with a shock tube.

Both transmitter 20 and receiver 30 both employ dual independent processors. Each processor is of a different type whereby the code for each processor written by independent software teams to avoid common coding errors. The software is developed in accordance with Def Stan 00-55 and maintained in a controlled document environment. Software written in C code following strict coding practices including:

Strict control on use of registers to minimise accidental over-writes.

Use of a separate register bank for interrupt handling.

Use of interrupts restricted to timing and data reception.

Avoidance of the use of dynamic memory management.

Avoidance of the use of floating point arithmetic.

Protection of sensitive data by CRC checksums.

Software Verification is conducted using formal Software analysis including:

Safety commentary

Software Fault Tree Analysis (FTA)

Coding Standards Review against internal MAS Zengrange RI Coding Standards

Formal Software Design Verification

The preferred specification requirements of the remote initiator breaching system 10 are as follows:

| Size | |
|---|---|
| Transmitter<br>80(W) × 70(L) × 35(D) mm | Receiver<br>80(W) × 70(L) × 35(D) mm |

| Weight | |
|---|---|
| Transmitter<br>100 grams, excluding battery | Receiver<br>140 grams, excluding battery |

| Temperature Range -- Transmitter/Receiver | |
|---|---|
| Operating: −21° C. to +58° C. | Storage: −40° C. to +70° C. |

Housings are typically constructed of injection moulded ABS/Polycarbonate.

Transit and Storage. The remote initiator breaching system is normally supplied in sets of 2 transmitter and 10 receivers, packaged together an injection molded ABS/Polycarbonate transit case. The case fitted with:

Silicone O-ring seal

Pressure equalisation valve

Internal partitions

Preferred electrical specifications are as follows:

Operating Frequency: Band E=868.7-869.2 MHz

Channel Spacing 12.5 kHz

Channels 16 channels within the band. The channels are operator selectable via the man-machine interface.

Modulation FSK

Transmitter Power Output 25 mW typical (14 dBm)

Operational Range 80 metres LOS

Error Correction Method Cyclic Redundancy Check (CRC) 16 Bit error checking

Firing Delay 0.5 seconds from commencement of firing transmission

Antenna Internal antenna, circular polarisation

Power & Operating Voltage

Transmitter 1×AA Lithium LR91 battery (1.5 v)

Receiver 1×AA Lithium LR91 battery (1.5 v)

User Battery Characteristics

Lithium AA LR91 Operating −21° C. to +58° C.

Receiver Sensitivity −121 dBm for 1×10-3 errors.

Receiver Safety Timer Post arming delay, via dual independent timers, specified by customer and programmed at manufacture Standard delay is 2 seconds.

Shock-tube Electro-static Firing Circuit

Stored Energy 6 Joules—Energy stored in charge capacitor.

As mentioned the remote initiator breaching system incorporates specific safety and security features required for safe and secure firing of the detonator by the remote initiator breaching system. These include:

Transmitter:

Built-in test circuits to confirm safety, reliability, and shut down in safe state if fault detected.

Simultaneous two button operation required for firing.

Firing buttons mounted on the side faces of the transmitter, orthogonal to the keypad to minimize probability of accidental firing if dropped.

Sensitive data held in memory is protected by CRC checksum.

Receiver

Disposable and intended for a single operational use,

Built-in test circuits to confirm safety, reliability, and shut down in safe state if fault detected.

A failure results in unit shutdown to a safe state and indication of fault type on LCD.

Software checks to back up hardware safety breaks.

Short circuit of discharge capacitor until authentication of firing command.

Sensitive data held in memory is protected by CRC checksum.

Duplication of critical components so that no single component failure is capable of causing unintended detonation.

LED communication indicator.

Coding

The firing code is a binary bit stream, which is base-band, modulated using encoding, and then transmitted using direct FSK modulation of the RF carrier.

Integrity of the transmission comes from the length of the code and the high level of error detection built into the coding scheme.

A number of different codes or identifiers are enabled in the transmission which must match keys with the receiver before a firing event is initiated.

The radio frequency (RF) characteristics for the remote initiator breaching system are as follows:

Transmitter

Frequency Range Band E=868.7-869.2 MHz

Installation Man Portable

Method of tuning Synthesised in 12.5 kHz steps

Channelling capacity 12.5 kHz steps

Frequency control VTCXO

Frequency stability ±1.0 ppm

Modulation FSK

Type of emission 8K0F1D

Power output 14 dBm (25 mW)

Second harmonic level −70 dBc

Third Harmonic level −70 dBc

Other Harmonic levels −80 dBc

Receiver

Frequency Range Band E=868.7-869.2 MHz

Installation type Man Portable

Method of tuning Synthesised in 12.5 kHz steps

Channeling capacity 12.5 kHz

Frequency control VTCXO

Frequency stability ±1.0 ppm

Modulation FSK

Type of emission 8K0F1D

Maximum bit rate 1200 bits per second

Image rejection −30 dB

Sensitivity −121 dBm for BER of <0.1%

Antenna

Antenna Type Internal

Antenna Polarisation Circular

The operation of the remote initiator breaching system is described by the flowcharts as shown in FIGS. 8 to 12. The definitions used in the flowcharts are defined as follows:

ADR Address number of target receiver(s). Displayed on Transmitter and Receiver Units ARM Receiver unit Arm button Bar Activity bar; TX Bar on Transmitter 'progresses' vertically RX Dock Bar on receiver elements alternate in a heartbeat BIT Built-in-Test CHAN Displayed channel number Double-tap Rapid double press of a button EN Transmitter Unit Enable button EX Breaching explosive Fire Transmitter Unit Fire button Fn Transmitter Unit Function button LED Light-Emitting Diode. Capable of multiple colors OK Transmitter Unit Okay button ↑ Transmitter Unit Increment button RX Receiver Unit TX Transmitter Unit As mentioned previously the remote initiator breaching system is a short range initiator of the explosives used during an Explosive Method Of Entry (EMOE) operation. A remote initiator breaching system set normally consists of two transmitters (one is a back-up) and ten receivers. The units are small in size, light weight and as simple to use as is consistent with the operational scenarios. The remote initiator breaching system is optimised for short range use in urban environments and within steel compartments. Unbonded receivers (not bonded to any transmitter identity) maybe purchased to replace receivers consumed in operations. The current receiver initiates Shock-tube with an electro-static discharge.

Figure 8:
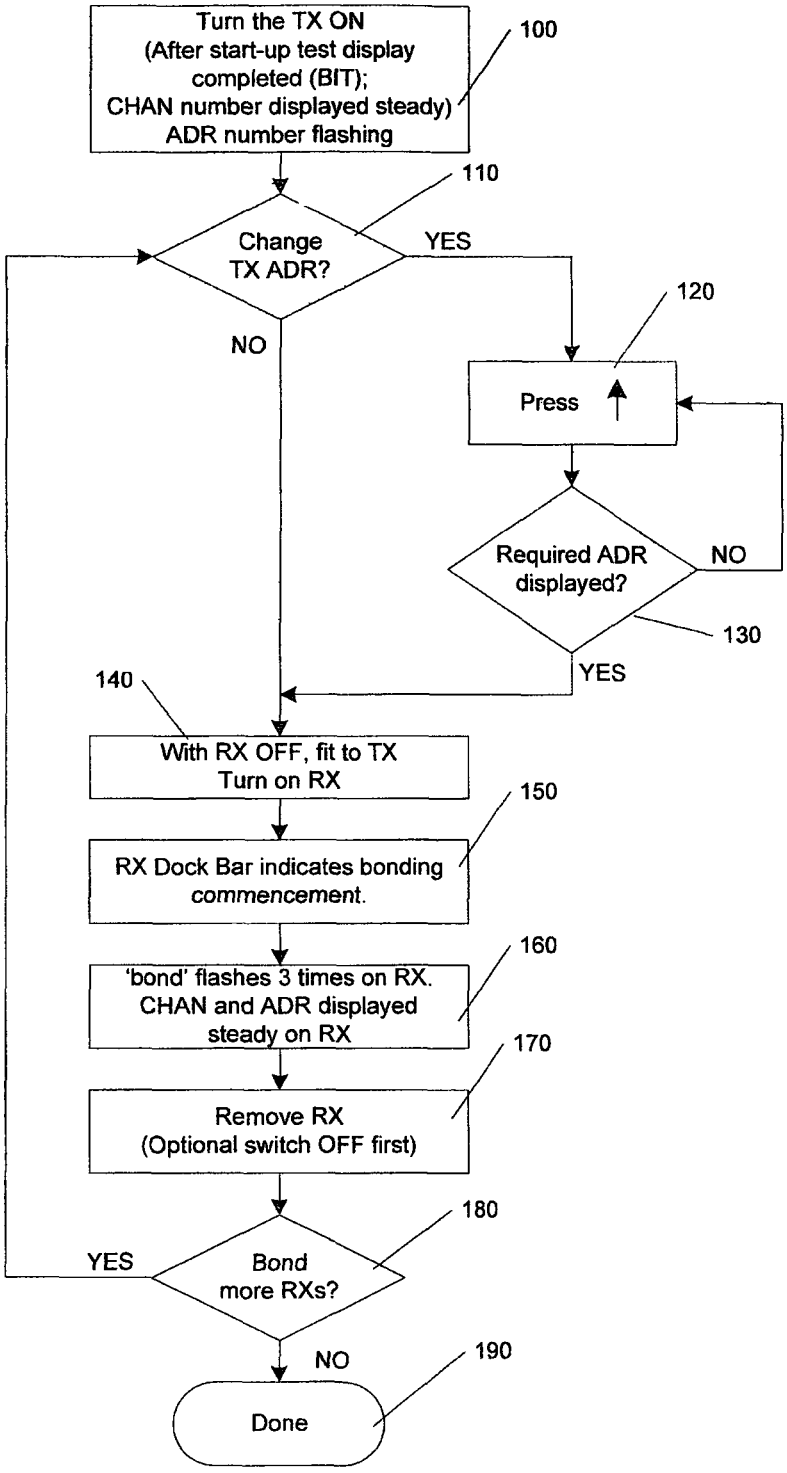

FIG. 8 pertains to a flow chart showing and describing the operational steps for bonding a receiver (or receivers) to a transmitter. Receivers may be supplied to a remote initiator breaching system unbonded (not holding any transmitter identification) or may need to be reconfigured from a current configuration to an at hand to transmitter Unit. The bonding of a receiver to a transmitter involves turning the TX on 110, change the ADR 110 if required 120, 130. The RX whilst off is fitted to the TX 140 and the RX dock bar indicates bonding commencement 150. Bond flashes 3 times on RX and CHAN and ADR are displayed on the RX 160 and the ne the RX is removed 170 and if more RX are to be 180 steps 110 to 170 are repeated for each RX, an then once bonding is done 190 the RX's are ready for deployment.

Figure 9:
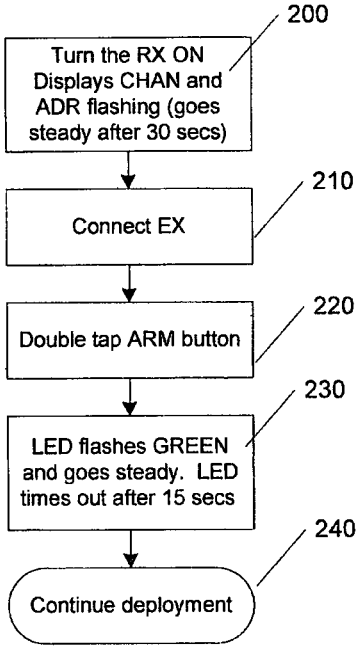

FIG. 9 pertains to a flow chart showing and describing the operational steps involved for the deployment of receiver(s). The receiver(s) are activated at the operational site. The defined safe condition is with receiver switched ON which ensures that the safety gates are in their defined safe states. To deploy the receivers involves the following steps. The RZ are turned on in which the CHAN and ADR flash and then go steady after 30 seconds 200. The EX is then connected 210 and the ARM button is double tapped 220. The LED light flashes green and then goes steady 230 and times out after 15 seconds and deployment is then continued 240.

Figure 10:
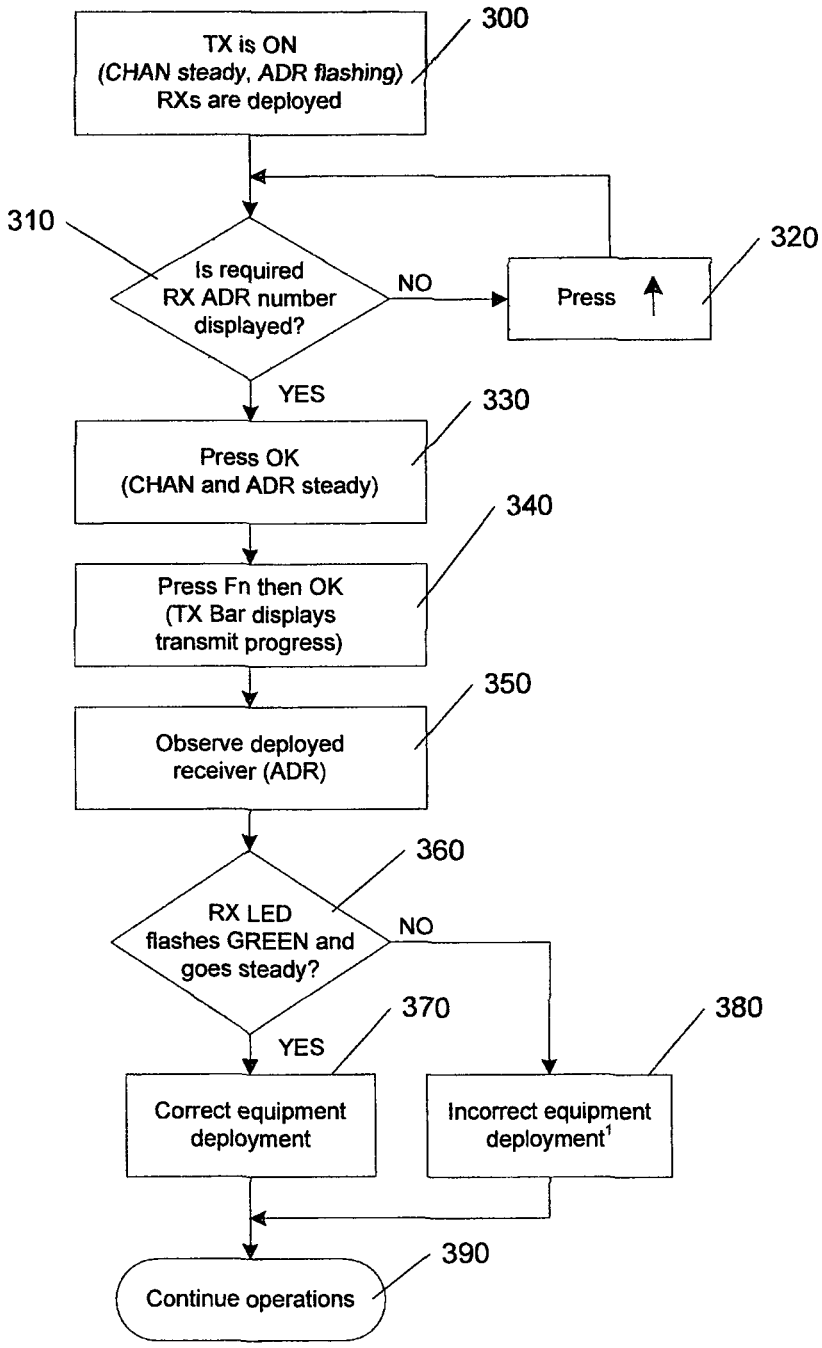

FIG. 10 pertains to a flow chart showing and describing the operational steps involved carrying out communications check on receivers. Note from FIG. 9 a deployed receiver display times-out (goes blank) after 30 seconds. If the operator wishes to observe the receiver information display or check that RF path to the receiver is open, they carry out the communications check (Comm.s Check). Communication checks on the receiver involves having the TX on with CHAN steady and ADR flashing and the receiver deployed 300. Then a check on if the RX ADR number is displayed is carried out 310. If it is not then it is corrected so that it is 320. Upon the ADR being displayed on the receiver the OK button is pressed 330 followed by the Fn button and the OK button such that the TX bar displays transmit progress 340. The deployed receiver is then observed 350 to check 360 if the Rx LED flashes green and goes steady. If not Incorrect equipment is deployed 380. Otherwise correct equipment is deployed 370 and operations are able to be continued 390. Note: the superscript numeral 1 in box 380 denotes No flashing=no reception, Red Flashing, equipment failure or not Armed.

Figure 11:
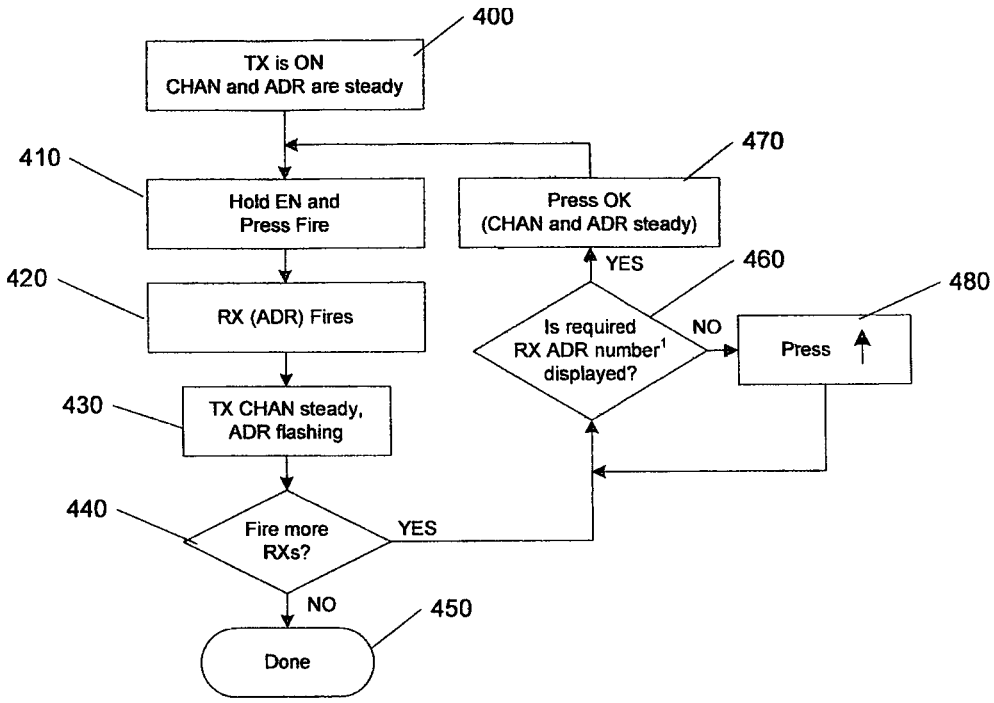

FIG. 11 pertains to a flow chart showing and describing the operational steps involved in remote initiation firing. Individual receivers may be initiated separately provided that they have a unique ADR, or initiated groups of same ADR or all the receivers active within a set initiated with the (A)ll ADR. Remote initiation firing involves having the TX on with CHAN and ADR displayed as steady 400. The EN button is held and Fire is pressed 410 and the RX fires 420. The CHAN remains steady and the ADR flashes on the TX 430. Then a check 440 is undertaken—if no more RXs are to be fired then the firing done 450, however if more RXs are to be fired then the required RX ADR number is displayed 460, if not the up arrow is pressed until it is displayed 480. If and once the required ADR number is displayed OK is pressed and the CHAN and ADR are displayed as steady 470, then steps 410 to 440 are repeated. Note: the superscript numeral 1 in box 460 includes "A" for ALL receivers.

Figure 12:
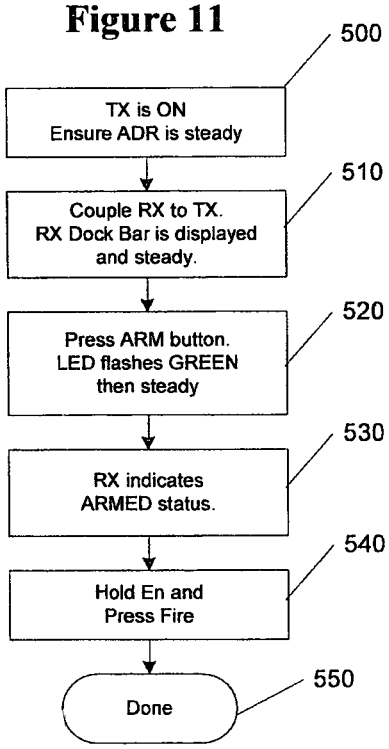

FIG. 12 pertains to a flow chart showing and describing the operational steps involved in manual firing whereby the receiver is docked to a transmitter Manual firing initiation in high electro-magnetic fields (e.g. Radar installation) is preferred as it maybe impossible to establish a RF link from the transmitter to the receiver. In this instance the TX is activated to be on 500 and then a RX is docked 510 onto to the TX whereby Dock Bar is displayed in a steady state once docking is complete. The ARM button is then press 520 followed by the RX indicating an ARMED status 530. The EN button is held and Fire is pressed 540 and the firing is done 550.

The remote initiator breaching system allows maximum mobility of the user during operations. Overall size and weight is minimised to allow one Breacher to carry a set consisting of two Transmitters and ten receivers during a typical operation. The operating range of the remote initiator breaching system is 80 m (Line of Sight—LOS). No Line of Sight (NLOS) operating range will be dependant upon factors such the building/, structure, geographical location, etc, and will be generally be less than LOS. The transmitter is expected to have a life expectancy in the field of 3 years and a shelf life of 5 years when packaged. The receiver shall only have a life of one use and a shelf life of 5 years when packaged. The remote initiator breaching system is designed to be operated with or with gloves.

Channel selection of the remote initiator breaching system includes the capability to select any of 16 operating frequency channels. Collocated systems can therefore be set to different channels, i.e. different frequencies, to prevent mutual interference. The communication code structure allows guaranteed uniqueness of code different system sets and allows guaranteed uniqueness of code for different receiver addresses.

The delay from the initiation of a firing command from the transmitter keypad to appearance of a firing spark on the receiver shock tube interface is not more than 0.5 sec. The remote initiator breaching system is capable of firing ten addresses consecutively with a maximum interval period of <4 seconds between each firing command.

The remote initiator breaching system operates in the frequency range 868.7-869.2 MHz and the channel spacing is 12.5 kHz.

The firing code includes sufficient data to allow a designated transmitter to fire one or more designated receivers without any possibility of confusion or misinterpretation. A Firing Code Protection recognises the high probability of bit errors in a radio environment such that the firing code includes protection bytes to prevent one or more corrupted bits from misinterpretation leading to a firing event in a receiver other than the targeted receiver. The firing code includes a segment of information which only the primary controller can generate/interpret and a further segment of information which only the secondary controller can generate/interpret. If a controller attempts to interpret the segment for the other the error check sequence shall fail. The structure of the firing code is distinct so that a transmission for any other purpose cannot be confused as a firing code event if that code is corrupted.

The Transmitter is capable of transmitting a firing code at a selected frequency/channel. The initiation of a firing code transmission must require the operation of two keys (Enable and Fire). At power-on the display activates all display segments and illuminate the LEDs for a period of 1.5 s and blank the display for 0.5 s before displaying actual status on the display. The Transmitter has the capability of being set to one of 16 channels, where each channel is associated with a particular frequency band. Once selected, another step can be used for the channel setting to be locked in. To change the channel setting requires a deliberate, e.g. two button process, to minimise the possibility of changing the channel by accident. The transmitter has capability of selecting one of 10 addresses. Once selected, another step shall be used for the address setting to be locked in. Once a transmitter is configured, the configuration settings will not be affected by on/off switching or changing the battery. Once the transmitter is configured by setting the channel and address, this information together with a unique transmitter pair identification code, is made available to be transferred to the receiver. The transfer of information is done through direct electrical connection between RX and TX. The transmitter housing is made from suitable moulded plastic, allowing mass production processing and suitably robust to withstand typical operational handling. A bonding/mounting interface on the transmitter allows for electrical contact between TX and RX to transfer configuration data and allows to positively locate the receiver on the transmitter during bonding. The housing of the transmitter is a fully sealed enclosure to withstand environmental conditions. The battery compartment within the transmitter is constructed and adapted to allow the battery to be easily replaced and to prevent internal interference to the unit during battery replacement. When fitted with a new battery, the transmitter is able to comfortable perform the following sequence without battery replacement:

Switched on for 24 hours with no other operations
40 Receiver bondings
40 Receivers health check
40 Fire commands.

The transmitter has a capability to detect specific safety related hardware failures and take appropriate action to identify and report the failure, and to place the transmitter in a safe and non-functional state in the event that a failure is detected.

The receiver is light, small and easy to handle during breaching operations. In most operations it is able to be placed in close proximity to the explosive charge and as a result is a disposable unit. The configuration of the receiver is by the transmitter and this setting ensures that the receiver only responds to this uniquely associated transmitter pair. The receiver is capable of interrogating a firing command and initiating a firing sequence, but only in response to a command from the uniquely associated transmitter. Once the unit has been powered up, the arming sequence is initiated by a dedicated button. The receiver shall generate the required signal (energy/spark) to reliably initiate a shock tube on receiving an appropriate firing command. The receiver displays its configuration data, channel and address while in the On position. When placed on a live transmitter in the bonding position, the receiver activates the transfer of configuration data from TX to RX and a suitable indication confirms the successful transfer of configuration data. On power-on the display activates all segments and illuminate the LEDs for a period of 1.5 s and blank the display for 0.5 s before displaying actual status and configuration. The supplement LEDS provide status reports as follows:

power on indicator which includes health check.
good communications indicator with a 180° field of view.
armed status
confirmation of successful configuration during bonding (this could potentially be replaced by an indication on the display)

Once a receiver is configured through bonding, the configuration settings are retained, even with battery removed. The display is able to be reset to default through zeroising. The receiver housing is made from moulded plastic that is suitably robust to withstand operational handling. The receiver housing is a fully sealed enclosure to withstand environmental conditions. A bonding/mounting interface on the receiver allows for electrical contact between TX and RX to transfer configuration data and positive positioning on the transmitter. The receiver has a mechanical interface for clipping onto a shock tube, at any position along the length of the shock tube, and to induce a spark to reliably initiate the shock tube. The shock tube interface provides for two diameters of shock tube, 2 mm and 3 mm. The battery compartment receiver is constructed to allow for easy battery removal and replacement, and to prevent internal interference/contamination to the unit during battery replacement.

When fitted with a new battery, the unit shall comfortably perform the following sequence without battery replacement:

Switched on for 3 hours followed by
5 Bonding operations
5 health checks
1 Arm sequence
5 hours in Armed state
1 shock tube initiation.

The receive function of the receiver is inactive at switch-on and is only activated during the bonding process. The frequency shall be set during bonding. The communication signal occupies a bandwidth not exceeding 12.5 kHz. The receive sensitivity of the receiver in conjunction with the transmitter output power, ensures that the required LOS and NLOS communications distances are able to be achieved. The receiver has a capability to detect specific safety related hardware failures and take appropriate action to identify and report the failure, and to place the receiver in a safe but non-function state in the event that a failure is detected. Dual safety timers with independent timing sources are included in the receiver to prevent arming of the receiver until a fixed time has elapsed from the initiation of arming. If the two safety timers do not time out within a specified time of each other the receiver indicates an error and does not proceed to its armed state. The safety timers include timing sources which are independent of each other. The firing capacitor within the receiver discharges any remaining voltage therein within 30 seconds of power-down and on voltage exists over the firing capacitor prior to charging. If the charge voltage is not reached, or if it exceeds specification, the receiver is programmed to place itself in a safe state in a controlled manner. During supply start-up and shutdown the receiver maintains all safety sensitive signals in a safe state.

Advantages a) Improved safety
b) short range operation.
c) no physical link between the breacher and the demolition charge
d) Single or multi receiver operation
e) Dual microprocessors
f) Sharing of common signalling code between transmitter and receiver(s)

Variations

Throughout the description of this specification, the word "comprise" and variations of that word such as "comprising" and "comprises", are not intended to exclude other additives components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is herein described in the appended claims

What we claim is:

1. A remote initiator breaching system for initiating breaching charges over a short range requiring no physical link between the breacher and the demolition charge, the remote initiator breaching system includes at least one transmitter, at least one receiver, at least one shock tube connectable to a breaching charge and a power source for each of the transmitter and receiver, wherein the transmitter includes (i) means for generating and transmitting a coded signal and input means for inputting operational commands into the transmitter for generating the coded signal, (ii) a plurality of channels representing different frequency bands, and (iii) a plurality of addresses for each channel such that transmission of coded signal from the transmitter to the receiver is possible per individual addresses or all addresses simultaneously, and wherein the receiver includes (i) a shock tube interface adapted to interface directly with the shock tube connected to a breaching charge, (ii) a spark-initiator for initiating a spark at the shock tube interface in order to initiate the shock tube, and (iii) means for receiving the coded signal from the transmitter and input means for inputting operational commands into the receiver for generating an output signal for the initiation of the shock tube upon receipt of a valid transmitted coded signal.

2. The remote initiator breaching system as claimed in claim 1, wherein the remote initiator breaching system has two transmitters, the first being a primary transmitter and the second a back up transmitter, wherein the back up transmitter is configured and coded the same as the primary transmitter.

3. The remote initiator breaching system as claimed in claim 1, wherein the remote initiator breaching system consists of a primary transmitter, a backup transmitter and up to ten receivers, wherein the receivers are bonded to the primary transmitter and adapted to be initiated individually or all at the same time.

4. The remote initiator breaching system as claimed in claim 1, wherein the remote initiator breaching system has a bonding/mounting interface on both the transmitter and receiver, the bonding/mounting interface is adapted to allow for electrical contact between transmitter and receiver to transfer configuration data from the transmitter to the receiver and to allow positive location of the receiver on the transmitter during bonding.

5. The remote initiator breaching system as claimed in claim 4, wherein the receiver is adapted to dock via the bonding/mounting interface with the transmitter in high electro-magnetic environments in order to allow for manual firing of a single circuit wherein the transmitter does not transmit radio frequency signals to the receiver in this situation.

6. The remote initiator breaching system as claimed in claim 1, wherein the transmitters and receivers have internal antennae.

7. The remote initiator breaching system as claimed in claim 1, wherein each transmitter and each receiver have dual processing means that are independent of each other to provide independent control of a firing circuit and the dual processing means adapted to synchronise with each processing means before initiation can occur so as to enhance safety and reliability of the transmitter and receiver and the initiation of the remote initiator breaching system.

8. The remote initiator breaching system as claimed in claim 1, wherein the receiver has 180° viewable indicators so that the operator can carry-out communications check from a distance from the receiver.

9. The remote initiator breaching system as claimed in claim 1, wherein the remote initiator breaching system operates over short ranges in constrained environments.

10. The remote initiator breaching system as claimed in claim 9, wherein the remote initiator breaching system operates within a distance of less than 100 m between the transmitter and the receiver.

11. The remote initiator breaching system as claimed in claim 1, wherein the receiver is disposable and useable once.

12. The remote initiator breaching system as claimed in claim 1, wherein the remote initiator breaching system is made from light weight material.

13. The remote initiator breaching system as claimed in claim 1, wherein the transmitter includes attachment means such that the transmitter is adapted to be worn on the wrist of a user.

14. The remote initiator breaching system as claimed in claim 1, wherein the remote initiator breaching system includes both shock-tube and electrical receiver initiators.

15. The remote initiator breaching system as claimed in claim 1, wherein the remote initiator breaching system includes the capability to select any of 16 operating frequency channels, where each channel is associated with a particular frequency band.

16. The remote initiator breaching system as claimed in claim 1, wherein delay from initiation of a firing command from the transmitter to appearance of a firing spark on the receiver shock tube interface is not more than 0.5 sec.

17. The remote initiator breaching system as claimed in claim 1, wherein the remote initiator breaching system is capable of firing ten addresses consecutively with a maximum interval period of <4 seconds between each firing command.

18. The remote initiator breaching system as claimed in claim 1, wherein the remote initiator breaching system operates in the frequency range 868.7-869.2 MHz and has a channel spacing of 12.5 kHz.

19. The remote initiator breaching system as claimed in claim 1, wherein the transmitter is capable of transmitting a firing code at a selected frequency or channel.

20. The remote initiator breaching system as claimed in claim 1, wherein the transmitter includes two keys such that the initiation of a firing code transmission requires the operation of the two keys on the transmitter.

21. The remote initiator breaching system as claimed in claim 1, wherein the receiver has a mechanical interface for clipping onto the shock tube.

22. The remote initiator breaching system as claimed in claim 21, wherein the shock tube interface is able to accommodate for two diameters of shock tube.

23. The remote initiator breaching system as claimed in claim 1, wherein the receiver includes dual safety timers with independent timing sources such that the dual safety timers are adapted to prevent arming of the receiver until a fixed time has elapsed from the initiation of arming so that if the two safety timers do not time out within a specified time of each other the receiver indicates an error and does not proceed to its armed state.

24. The remote initiator breaching system as claimed in claim 1, wherein the transmitter includes built-in test circuits to confirm safety, reliability, and shut down in safe state if a fault is detected.

25. The remote initiator breaching system as claimed in claim 1, wherein the receiver includes built-in test circuits to confirm safety, reliability, and shut down in safe state if a fault is detected.

26. A method of operating the remote initiator breaching system as claimed in claim 1, wherein, the method includes (i) bonding of a receiver or receivers to the transmitter (ii) deployment of the bonded receiver or receivers (iii) undertaking a communications check on the receiver or receivers and (iv) firing the remote initiator breaching system remotely or manually.

27. The method as claimed in claim 26, wherein when the firing is done remotely the firing signal is relayed from the transmitter to the receiver by radio frequency signals.

* * * * *